US009142340B2

(12) United States Patent
Itami et al.

(10) Patent No.: US 9,142,340 B2
(45) Date of Patent: Sep. 22, 2015

(54) CHIP VARISTOR

(71) Applicant: TDK CORPORATION, Tokyo (JP)

(72) Inventors: Takahiro Itami, Tokyo (JP); Naoyoshi Yoshida, Tokyo (JP); Katsunari Moriai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 140 days.

(21) Appl. No.: 14/102,850

(22) Filed: Dec. 11, 2013

(65) Prior Publication Data

US 2014/0167909 A1 Jun. 19, 2014

(30) Foreign Application Priority Data

Dec. 17, 2012 (JP) ..... 2012-274633

(51) Int. Cl.

| | |
|---|---|
| ***H01C 7/10*** | (2006.01) |
| ***H01C 7/13*** | (2006.01) |
| ***H01C 7/12*** | (2006.01) |
| ***H01C 1/148*** | (2006.01) |
| ***H01C 7/18*** | (2006.01) |

(52) U.S. Cl.

CPC ..... *H01C 7/123* (2013.01); *H01C 1/148* (2013.01); *H01C 7/1006* (2013.01); *H01C 7/18* (2013.01)

(58) Field of Classification Search

CPC ..... H01C 7/123; H01C 1/148; H01C 7/18; H01C 7/1006

USPC ..... 338/20, 21, 13

See application file for complete search history.

(56) References Cited

U.S. PATENT DOCUMENTS

| | | | | |
|---|---|---|---|---|
| 6,232,867 | B1 * | 5/2001 | Yoshida et al. | 338/21 |
| 7,075,405 | B2 * | 7/2006 | Takehana et al. | 338/21 |
| 7,683,753 | B2 * | 3/2010 | Yoshida et al. | 338/21 |
| 2003/0043012 | A1 * | 3/2003 | Shiraishi et al. | 338/21 |
| 2008/0238605 | A1 * | 10/2008 | Yoshida et al. | 338/21 |
| 2009/0021340 | A1 * | 1/2009 | Koyama | 338/20 |

FOREIGN PATENT DOCUMENTS

| | | |
|---|---|---|
| JP | A-2002-246207 | 8/2002 |

* cited by examiner

*Primary Examiner* — Kyung Lee
(74) *Attorney, Agent, or Firm* — Oliff PLC

(57) ABSTRACT

An element body has first and second faces opposed to each other. A first conductor has one end exposed in a first face and the other end located in the element body. The second conductor has one end exposed in a second face and the other end located in the element body. The element body has a first element body section having the nonlinear voltage-current characteristics and a second element body section in which an electric current is more likely to flow than in the first element body section. The first element body section is located at least in part between the first conductor and the second conductor, in a direction in which the first conductor and the second conductor are separated from each other. The other end of the first conductor and the other end of the second conductor are located in the second element body section.

5 Claims, 10 Drawing Sheets

CHIP VARISTOR

BACKGROUND OF THE INVENTION

1. Field of the Invention

The present invention relates to a chip varistor.

2. Related Background Art

One of known chip varistors is a multilayer chip varistor provided with a varistor element body and a plurality of terminal electrodes arranged at ends of the varistor element body (e.g., cf. Japanese Patent Application Laid-Open Publication No. 2002-246207). The varistor element body has a varistor layer and a plurality of internal electrodes arranged in contact with the varistor layer so as to interpose the varistor layer between them. The plurality of terminal electrodes are connected to the respective corresponding internal electrodes. In the multilayer chip varistor, a region between the internal electrodes in the varistor layer functions as a region to exhibit the nonlinear voltage-current characteristics (hereinafter also referred to as "varistor characteristics").

SUMMARY OF THE INVENTION

When a surge voltage like ESD (Electrostatic Discharge) is applied to the multilayer chip varistor, a property to clamp ESD (hereinafter referred to as "clamp property") varies corresponding to the shortest distance between adjacent internal electrodes. Namely, the multilayer chip varistor has the shortest distance between adjacent internal electrodes being relatively small and thus demonstrates an excellent clamp property.

However, the multilayer chip varistor can have the problem as described below. When the surge voltage like ESD is applied to the multilayer chip varistor, an electric field distribution between the internal electrodes is concentrated at the edges of the internal electrodes. In the multilayer chip varistor, as described above, the internal electrodes are in contact with the varistor layer being a semiconductor. For this reason, when the electric field distribution is concentrated at the edges of the internal electrodes, tolerance against ESD (hereinafter referred to as "ESD tolerance") can suddenly drop.

An object of the present invention is to provide a chip varistor capable of preventing the drop of ESD tolerance while ensuring the clamp property.

The present invention provides a chip varistor comprising: an element body having a first face and a second face opposed to each other; a first conductor arranged in the element body so as to have one end exposed in the first face and the other end located in the element body; a second conductor arranged in the element body so as to have one end exposed in the second face and the other end located in the element body and so as to be separated from the first conductor; a first terminal electrode arranged on the first face side of the element body and connected to the first conductor; and a second terminal electrode arrange on the second face side of the element body and connected to the second conductor, wherein the element body has a first element body section having the nonlinear voltage-current characteristics, and a second element body section in which an electric current is more likely to flow than in the first element body section, wherein the first element body section is located at least in part between the first conductor and the second conductor, in a direction in which the first conductor and the second conductor are separated from each other, and wherein the other end of the first conductor and the other end of the second conductor are located in the second element body section.

In the present invention, the first conductor connected to the first terminal electrode and the second conductor connected to the second terminal electrode are arranged as separated from each other in the element body. Therefore, a desired clamp property can be ensured by adjusting the shortest distance between the first conductor and the second conductor.

In the present invention, the other end of the first conductor and the other end of the second conductor are located not in the first element body section but in the second element body section. For this reason, the other end of the first conductor and the other end of the second conductor are not in contact with the first element body section to exhibit the nonlinear voltage-current characteristics (varistor characteristics). Therefore, even if the surge voltage like ESD is applied to the chip varistor to cause an electric field distribution to be concentrated at the other ends of the first and second conductors, the drop of ESD tolerance can be prevented.

The first conductor and the second conductor may be located as a whole in the second element body section. In this case, the first conductor and the second conductor are arranged as separated from the first element body section. If the first element body section were in contact with the first and second conductors, a material making up the first element body section would react with a material making up the first and second conductors, which could cause degradation of the varistor characteristics. However, since the first and second conductors are arranged as separated from the first element body section, the degradation of the varistor characteristics can be prevented. Since this configuration reduces the need for consideration of reactivity with the material making up the first element body section, it increases the freedom for selection of the material making up the first and second conductors.

The first conductor and the second conductor may have a mutually overlapping portion when viewed from a direction perpendicular to a direction in which the first face and the second face are opposed to each other. In this case, the first conductor and the second conductor have the mutually overlapping portion, which decreases the resistance and achieves a good clamp property.

A portion of the element body exposed from the first terminal electrode and the second terminal electrode may have a resistance increased from the surface side of the element body. In this case, the region between the first terminal electrode and the second terminal electrode in the surface of the element body has the increased resistance, and thus an electric current is unlikely to flow in that region. Therefore, even if the surge voltage like ESD is applied to the chip varistor, the varistor characteristics can be securely exhibited between the first conductor and the second conductor.

The element body may have the first element body section and a pair of above-mentioned second element body sections arranged so as to interpose the first element body section between the second element body sections in a direction perpendicular to a direction in which the first face and the second face are opposed to each other; the first conductor may be arranged in one of the second element body sections so as to be opposed to the first element body section; the second conductor may be arranged in the other of the second element body sections so as to be opposed to the first element body section. In this case, the chip varistor can be readily constructed in the structure in which the first conductor and the second conductor are located as a whole in the second element body sections.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description the same elements or elements with the same functionality will be denoted by the same reference signs, without redundant description.

Figure 1:
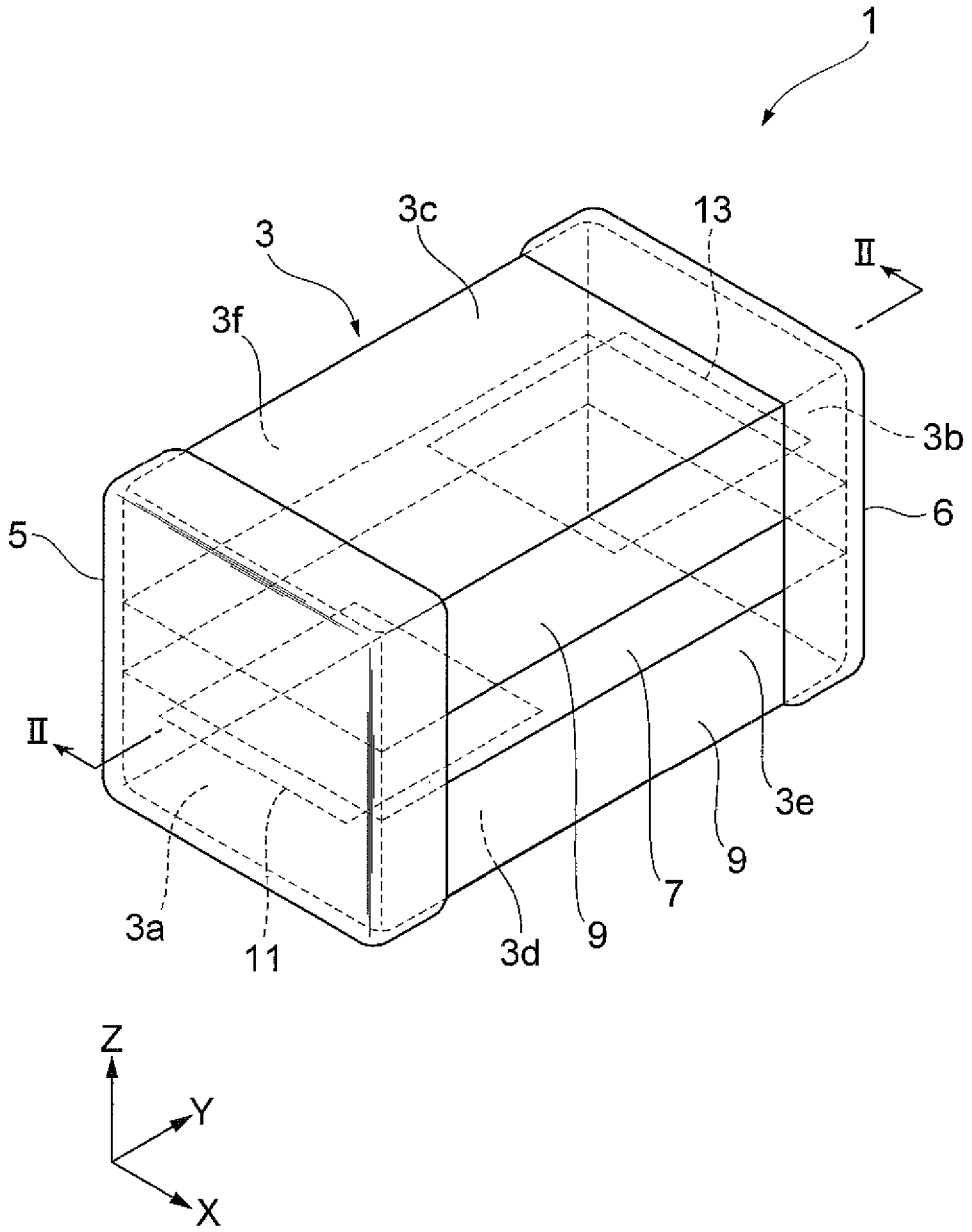
FIG. 1 is a perspective view showing a chip varistor according to an embodiment of the present invention.
Figure 2:
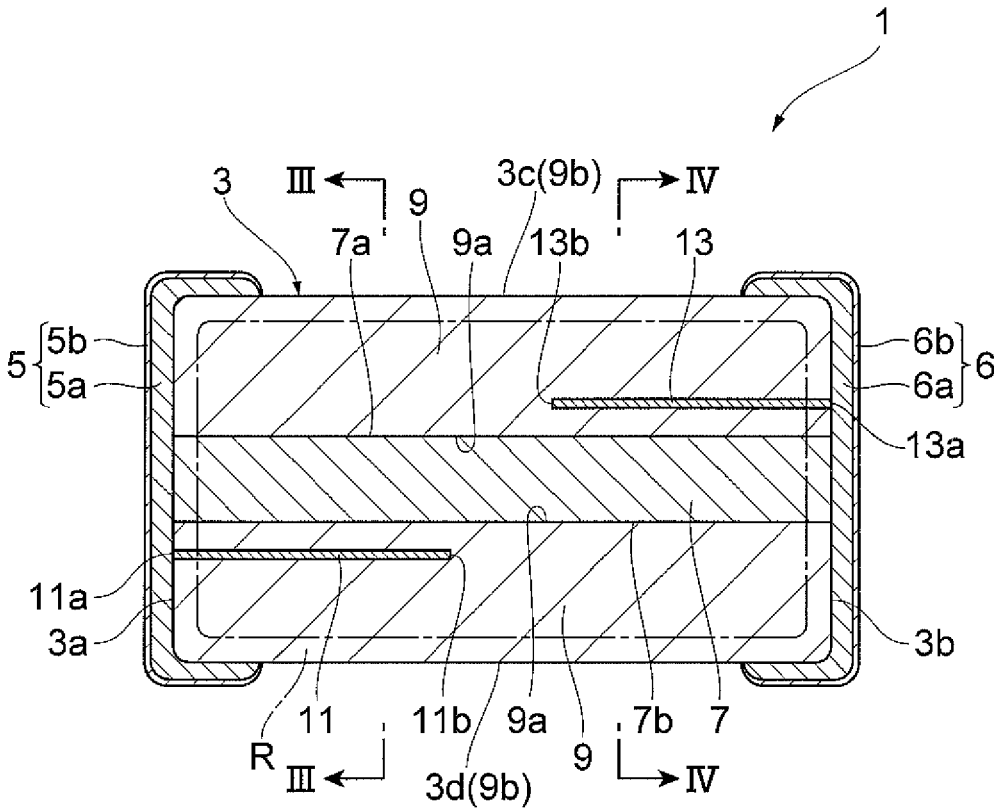
FIG. 2 is a drawing for explaining a cross-sectional configuration along the line II-II in FIG. 1.
Figure 3:
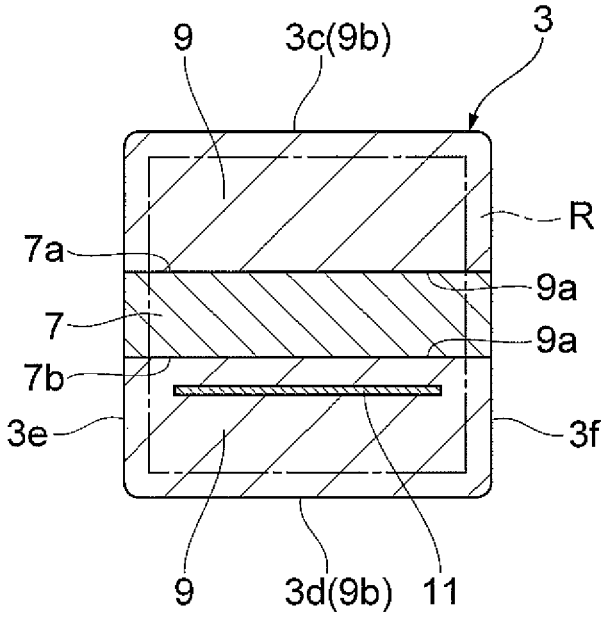
FIG. 3 is a drawing for explaining a cross-sectional configuration along the line in FIG. 2.
Figure 4:
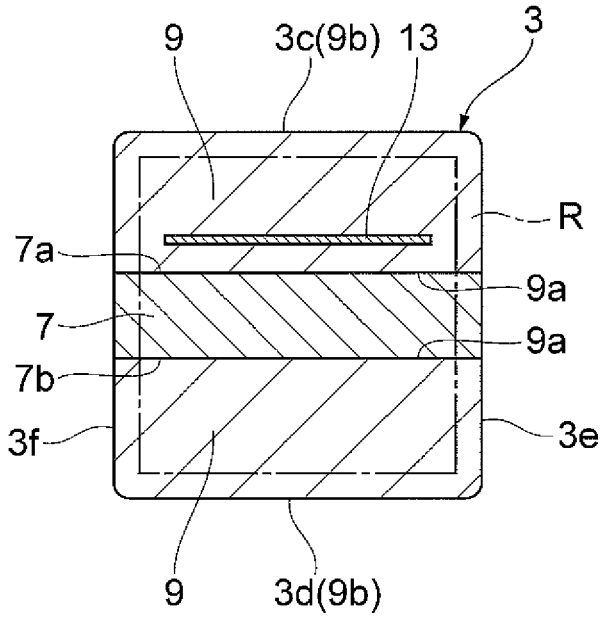
FIG. 4 is a drawing for explaining a cross-sectional configuration along the line IV-IV in FIG. 2.

First, a configuration of chip varistor 1 according to an embodiment of the present invention will be described with reference to FIGS. 1 to 5. FIG. 1 is a perspective view showing the chip varistor according to the present embodiment. FIG. 2 is a drawing for explaining a cross-sectional configuration along the line II-II in FIG. 1. FIG. 3 is a drawing for explaining a cross-sectional configuration along the line in FIG. 2. FIG. 4 is a drawing for explaining a cross-sectional configuration along the line IV-IV in FIG. 2.

The chip varistor 1, as also shown in FIG. 1, is provided with an element body 3 of a nearly rectangular parallelepiped shape, a first terminal electrode 5, and a second terminal electrode 6. The chip varistor 1 is, for example, one having the length of 0.6 mm in the Y-direction, the height of 0.3 mm in the Z-direction, and the width of 0.3 mm in the X-direction in the drawing. The chip varistor 1 is a so-called 0603-size chip varistor.

The element body 3, as also shown in FIGS. 2 to 4, has a first element body section 7, and a plurality of second element body sections (two second element body sections in the present embodiment) 9. The element body 3 has, as the exterior surface, end faces 3*a*, 3*b* of a square shape opposed to each other and four side faces 3*c*-3*f* perpendicular to the end faces 3*a*, 3*b*. The four side faces 3*c*-3*f* extend so as to connect the end faces 3*a*, 3*b*. The two second element body sections 9 are arranged so as to interpose the first element body section 7 between them, in a direction in which the side face 3*c* and the side face 3*d* are opposed to each other.

The first element body section 7 is a portion of a rectangular parallelepiped shape located nearly in the center of the element body 3 in the direction in which the side face 3*a* and the side face 3*d* are opposed to each other. The first element body section 7 is comprised of a sintered body (semiconductor ceramic) to exhibit the varistor characteristics. The first element body section 7 is a layered structure consisting of a plurality of layers of sintered bodies to exhibit the varistor characteristics. It is noted that in the actual element body 3, the layers forming the first element body section 7 are integrated so that no boundary can be visually recognized between the layers. The first element body section 7 includes a pair of principal faces 7*a*, 7*b* opposed to each other in its thickness direction (or the Z-direction in the drawing). The thickness of the first element body section 7 is set, for example, in the range of about 3 to 150 μm.

The first element body section 7 contains ZnO (zinc oxide) as a major component and also contains minor components of metals such as Co, a rare earth metal, a Group Mb element (B, Al, Ga, In), Si, Cr, Mo, an alkali metal (K, Rb, Cs), and an alkaline-earth metal (Mg, Ca, Sr, Ba), or oxides of these. In the present embodiment the first element body section 7 contains Co, Pr, Cr, Ca, K, and Al as minor components. There are no particular restrictions on a content of ZnO in the first element body section 7, but the content is usually from 99.8 to 69.0% by mass when the total content of all components making up the first element body section 7 is 100% by mass.

The rare earth metal (e.g., Pr) acts as a substance to promote exhibition of the varistor characteristics. A content of the rare earth metal in the first element body section 7 is set, for example, in the range of about 0.01 to 10 atomic %.

The second element body sections 9 are portions of a nearly rectangular parallelepiped shape and are arranged on both sides of the first element body section 7 so as to interpose the first element body section 7 between them. Each of the second element body sections 9 is a layered structure consisting of a plurality of layers of sintered bodies containing ZnO as a major component. It is noted that in the actual element body 3, the layers forming each second element body section 9 are integrated so that no boundary can be visually recognized between the layers.

Each second element body section 9 has a principal face 9*a* connected to the first element body section 7 (principal face 7*a* or 7*b* thereof) and a principal face 9*b* opposed to the principal face 9*a*. In the present embodiment, almost the entire area of each principal face 7*a*, 7*b* of the first element body section 7 is connected in contact with the principal face 9*a* of the corresponding second element body section 9. The principal faces 9*a* of the second element body sections 9 have much the same shape as the principal faces 7*a*, 7*b* of the first element body section 7. Each principal face 9*b* constitutes the corresponding side face 3*c* or 3*d* of the element body 3.

The second element body sections 9 are comprised of the sintered bodies containing ZnO as a principal component, as described above. The resistivity of ZnO is from 1 to 10 Ω·cm and thus ZnO has relatively high electrical conductivity. The second element body sections 9 may contain metals such as Co, a Group IIIb element (B, Al, Ga, In), Si, Cr, Mo, an alkali metal (K, Rb, Cs), and an alkaline-earth metal (Mg, Ca, Si, Ba) or oxides of these metals as minor components, for adjustment of resistivity. There are no particular restrictions on a content of ZnO in the second element body sections 9, but it is, for example, from 100 to 69.0% by mass when the total content of components making up the second element body sections 9 is 100% by mass.

If the second element body sections 9 should substantially contain a rare earth metal, the second element body sections 9 could exhibit the varistor characteristics. For this reason, the second element body sections 9 preferably substantially contain no rare earth metal. When the second element body sections 9 substantially contain no rare earth metal, they are unlikely to exhibit the varistor characteristics. Therefore, the second element body sections 9 have low electric resistance and relatively high electric conductivity. For this reason, an electric current is more likely to flow in the second element body sections 9 than in the first element body section 7.

A state in which "the sections substantially contain no rare earth metal" herein refers to a state in which any rare earth metal was not intentionally added in raw materials in preparing the material making up the second element body sections 9. For example, a case where such a rare earth metal is contained unintentionally because of diffusion or the like from the first element body section 7 into the second element body sections 9 corresponds to the state in which "the sections substantially contain no rare earth metal."

The chip varistor 1, as shown in FIGS. 2 to 4, is provided with a first conductor 11 and a second conductor 13, which are arranged as separated from each other in the element body 3. The first and second conductors 11, 13 contain an electroconductive material. There are no particular restrictions on the electroconductive material contained in the first and second conductors 11, 13, but the electroconductive material is preferably comprised of Pd or an Ag—Pd alloy. The thickness of the first and second conductors 11, 13 is, for example, in the range of about 0.1 to 10 μm.

The first conductor 11 is arranged in one of the second element body sections 9. The first conductor 11 has one end 11*a* exposed in the end face 3*a* and the other end 11*b* located in the second element body section 9. Namely, the first conductor 11 is located as a whole in the second element body section 9. The first conductor 11 is located in one second element body section 9 in a state in which it has a predetermined space from the principal face 7*a* of the first element body section 7 (the principal face 9*a* of the second element body section 9) and is approximately in parallel with the principal face 7*a* of the first element body section 7 (the principal face 9*a* of the second element body section 9).

The second conductor 13 is arranged in the other of the second element body sections 9. The second conductor 13 has one end 13*a* exposed in the end face 3*b* and the other end 13*b* located in the second element body section 9. Namely, the second conductor 13 is located as a whole in the second element body section 9. The second conductor 13 is located in the other second element body section 9 in a state in which it has a predetermined space from the principal face 7*b* of the first element body section 7 (the principal face 9*a* of the second element body section 9) and is approximately in parallel with the principal face 7*b* of the first element body section 7 (the principal face 9*a* of the second element body section 9).

In the present embodiment, the first conductor 11 and the second conductor 13 are arranged as separated from each other, when viewed from the direction in which the side face 3*c* and the side face 3*d* are opposed to each other, i.e., from a direction perpendicular to a direction in which the end face 3*a* and the end face 3*b* are opposed to each other. Namely, the first conductor 11 and the second conductor 13 have no overlap when viewed from the direction in which the side face 3*c* and the side face 3*d* are opposed to each other. The shortest distance between the first conductor 11 and the second conductor 13 is defined by a distance between the other end 11*b* of the first conductor 11 and the other end 13*b* of the second conductor 13.

The first terminal electrode 5 is arranged on the end face 3*a* side of the element body 3. The first terminal electrode 5 is formed of multiple layers so as to cover the end face 3*a* and portions of the four side faces 3*c*-3*f* nearer to the end face 3*a*. The first terminal electrode 5 is formed so as to also cover the one end 11*a* of the first conductor 11 exposed in the end face 3*a* of the element body 3 and the first terminal electrode 5 is directly connected to the first conductor 11. The first terminal electrode 5 includes a first electrode layer 5*a* and a second electrode layer 5*b*.

The second terminal electrode 6 is arranged on the end face 3*b* side of the element body 3. The second terminal electrode 6 is formed of multiple layers so as to cover the end face 3*b* and portions of the four side faces 3*c*-3*f* nearer to the end face 3*b*. The second terminal electrode 6 is formed so as to also cover the one end 13*b* of the second conductor 13 exposed in the end face 3*b* of the element body 3 and the second terminal electrode 6 is directly connected to the second conductor 13. The second terminal electrode 6 also includes a first electrode layer 6*a* and a second electrode layer 6*b*.

The first electrode layers 5*a*, 6*a* are formed by applying an electro conductive paste onto the surface of the element body 3 and sintering it. Namely, the first electrode layers 5*a*, 6*a* are sintered electrode layers. The electro conductive paste used herein is one obtained by mixing a glass component, an organic binder, and an organic solvent in a powder consisting of a metal (e.g., Pd, Cu, Ag, or an Ag—Pd alloy). The second electrode layers 5*b*, 6*b* are formed by plating on the first electrode layers 5*a*, 6*a*. In the present embodiment, each second electrode layer 5*b*, 6*b* includes an Ni-plated layer formed by Ni plating on the first electrode layer 5*a*, 6*a*, and an Sn-plated layer formed by Sn plating on the Ni-plated layer. The second electrode layers 5*b*, 6*b* can be excluded depending upon the material used for the first electrode layers 5*a*, 6*a*.

In the chip varistor 1, the first element body section 7 is located at least in part between the first conductor 11 and the second conductor 13, in a direction in which the first conductor 11 and the second conductor 13 are separated from each other. In the present embodiment, the first element body section 7 is located in the middle of a path connecting the other end 11*b* of the first conductor 11 and the other end 13*b* of the second conductor 13.

The element body 3 has the resistance increased from the exterior surface 3*a*-3*f* side and the element body 3 has a resistance-increased region R along the whole of the exterior surface 3*a*-3*f*. Namely, each element body section 7, 9 has the region R on the corresponding exterior surface 3*a*-3*f* side. In the region R, there is at least one element selected from the group consisting of alkali metals, Ag, and Cu. In the region R, the at least one element selected from the group consisting of alkali metals, Ag, and Cu exists in a solid state as dispersed in crystal grains of ZnO, or exists at crystal grain boundaries of ZnO.

When the element selected from the group consisting of alkali metals, Ag, and Cu exists in a solid state as dispersed in crystal grains of ZnO, the foregoing element reduces the number of donors in ZnO exhibiting the property of n-type semiconductor, so as to lower the electric conductivity, resulting in restraining exhibition of the varistor characteristics. When the foregoing element exists at the crystal grain boundaries of ZnO, it is also considered that the electric conductivity becomes lowered. Therefore, the region R has the lower electric conductivity and lower capacitance than the other region of the element body 3.

The resistance-increased region R can be formed as described below. A method for manufacturing the chip varistor 1, except for a step of forming the resistance-increased region R, can be carried out using well-known steps employed in a method for manufacturing the multilayer chip varistor, and therefore detailed description is omitted herein.

After the element body 3 is provided, at least one element selected from the group consisting of alkali metals (e.g., Li, Na, and so on), Ag, and Cu is diffused from the exterior surface of the element body 3 (the pair of end faces 3*a*, 3*b* and the four side faces 3*c*-3*f*). The below will describe an example of diffusion of an alkali metal element.

First, an alkali metal compound is attached to the exterior surface of the element body 3. The attachment of the alkali metal compound can be implemented using a hermetically-closed rotary pot. There are no particular restrictions on the alkali metal compound, but it is a compound that can diffuse the alkali metal from the surface of the element body 3 when subjected to a thermal treatment, and can be an oxide, a hydroxide, a chloride, a nitrate, a borate, a carbonate, an oxalate, or the like of the alkali metal.

Then the element body 3 with the alkali metal compound attached thereto is thermally treated at a predetermined temperature and for a predetermined time in an electric furnace. This thermal treatment results in diffusing the alkali metal from the alkali metal compound through the exterior surface of the element body 3 into the interior. A preferred thermal treatment temperature is from 700° C. to 1000° C. and a thermal treatment atmosphere is the atmosphere. A thermal treatment time (retention time) is preferably from 10 minutes to 4 hours.

The portion in the element body 3 where the alkali metal element has diffused, i.e., the region R where the alkali metal element exists, comes to have the increased resistance and lowered capacitance as described above. In the present embodiment, the alkali metal element diffuses through the end faces 3*a*, 3*b*, but it does not inhibit the electrical connection between the terminal electrodes 5, 6 and the conductors 11, 13 because the conductors 11, 13 are exposed in the corresponding end faces 3*a*, 3*b*.

In the present embodiment, as described above, the first conductor 11 connected to the first terminal electrode 5 and the second conductor 13 connected to the second terminal electrode 6 are arranged as separated from each other in the element body 3. Therefore, the chip varistor 1 can ensure a desired clamp property by adjustment of the shortest distance between the first conductor 11 and the second conductor 13. The clamp property becomes more enhanced with decrease of the shortest distance between the first conductor 11 and the second conductor 13.

In the present embodiment, since the other end 11*b* of the first conductor 11 and the other end 13*b* of the second conductor 13 are located not in the first element body section 7 but in the second element body sections 9, these ends 11*b*, 13*b* are not in contact with the first element body section 7 which exhibits the varistor characteristics. Therefore, even if the surge voltage like EDS is applied to the chip varistor 1 to cause concentration of an electric field distribution at the other ends 11*b*, 13*b* of the first and second conductors 11, 13, the chip varistor 1 is prevented from dropping the ESD tolerance.

In the present embodiment, the first conductor 11 and the second conductor 13 are located as a whole in the second element body sections 9 and the first conductor 11 and the second conductor 13 are arranged as separated from the first element body section 7. If the first element body section 7 were in contact with the first and second conductors 11, 13, the material making up the first element body section 7 would react with the material making up the first and second conductors 11, 13, which could cause degradation of the varistor characteristics. However, since the first and second conductors 11, 13 are arranged as separated from the first element body section 7, the degradation of the varistor characteristics can be prevented. Since this configuration reduces the need for consideration of reactivity with the material making up the first element body section 7, it increases the freedom for selection of the material making up the first and second conductors 11, 13.

In the present embodiment, the element body 3 has the resistance-increased region R along the entire exterior surface 3*a*-3*f*. Namely, the portion exposed from the first terminal electrode 5 and the second terminal electrode 6 in the element body 3 has the resistance increased from the exterior surface side (the four side faces 3*c*-3*f* side) of the element body 3. Since the region between the first terminal electrode 5 and the second terminal electrode 6 in the exterior surface side of the element body 3 (region R) has the increased resistance, an electric current is unlikely to flow in that region. Therefore, even if the surge voltage like ESD is applied to the chip varistor 1, the varistor characteristics can be securely exhibited between the first conductor 11 and the second conductor 13.

The element body 3 has the first element body section 7, and the pair of second element body sections 9 arranged so as to interpose the first element body section 7 between them in the direction in which the side face 3*c* and the side face 3*d* are opposed to each other; the first conductor 11 is arranged in one of the second element sections 9 so as to be opposed to the first element body section 7; the second conductor 13 is arranged in the other of the second element body sections 9 so as to be opposed to the first element body section 7. This configuration makes it easier to construct the chip varistor 1 in which the first conductor 11 and the second conductor 13 are located as a whole in the second element body sections 9.

The following will specifically show that the present embodiment prevents the drop of ESD tolerance, based on Example and Comparative Example. In Example, the ESD tolerance of the chip varistor 1 was checked using the chip varistor 1 according to the above-described embodiment of the present invention. In Comparative Example, the ESD tolerance of a multilayer chip varistor 101 was checked using the multilayer chip varistor 101 having a configuration shown in FIG. 5.

Figure 5:
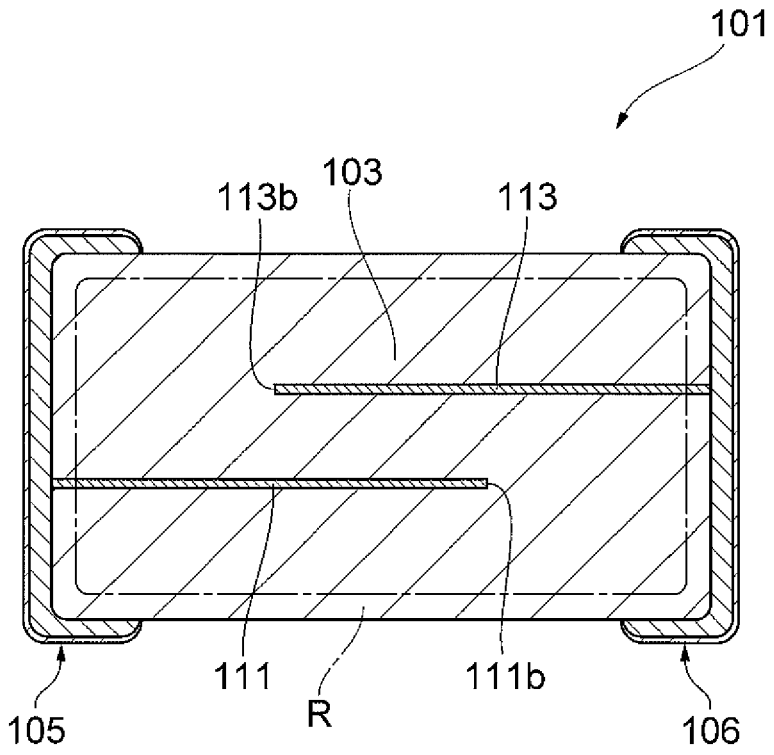
FIG. 5 is a drawing for explaining a configuration of a multilayer chip varistor according to a comparative example.

The multilayer chip varistor 101 of Comparative Example is provided, as shown in FIG. 5, with an element body 103 of a nearly rectangular parallelepiped shape and a pair of terminal electrodes 105, 106. The element body 103 is comprised of a sintered body (semiconductor ceramic) to exhibit the varistor characteristics. An end 111*b* of a conductor 111 connected to the terminal electrode 105 and an end 113*b* of a conductor 113 connected to the terminal electrode 106 are located in the sintered body (element body 103) which exhibits the varistor characteristics. In the multilayer chip varistor 101, the element body 103 also has the resistance increased from the exterior surface side as in the chip varistor 1.

The chip varistor 1 of Example has the capacitance of 1.89 pF at 1 MHz, the varistor voltage $V_{1\ mA}$ of 89 V, and the CV product of 169. The multilayer chip varistor 101 of Comparative Example has the capacitance of 1.50 pF at 1 MHz, the varistor voltage $V_{1\ mA}$ of 98 V, and the CV product of 152.

The ESD tolerance herein was evaluated by measuring a change of the varistor voltage $V_{1\ mA}$ with variation in discharge voltage (applied voltage), based on the electrostatic discharge immunity test defined in the standard IEC61000-4-2 by IEC (International Electrotechnical Commission).

Figure 6A:
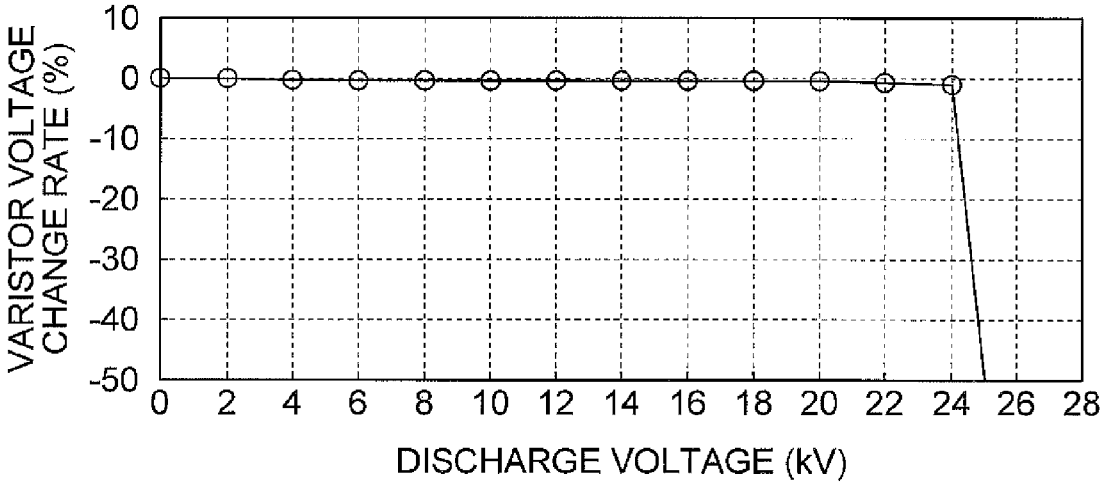
FIGS. 6A and 6B are graphs showing relations between discharge voltage (kV) and varistor voltage change rate (%).
Figure 6B:
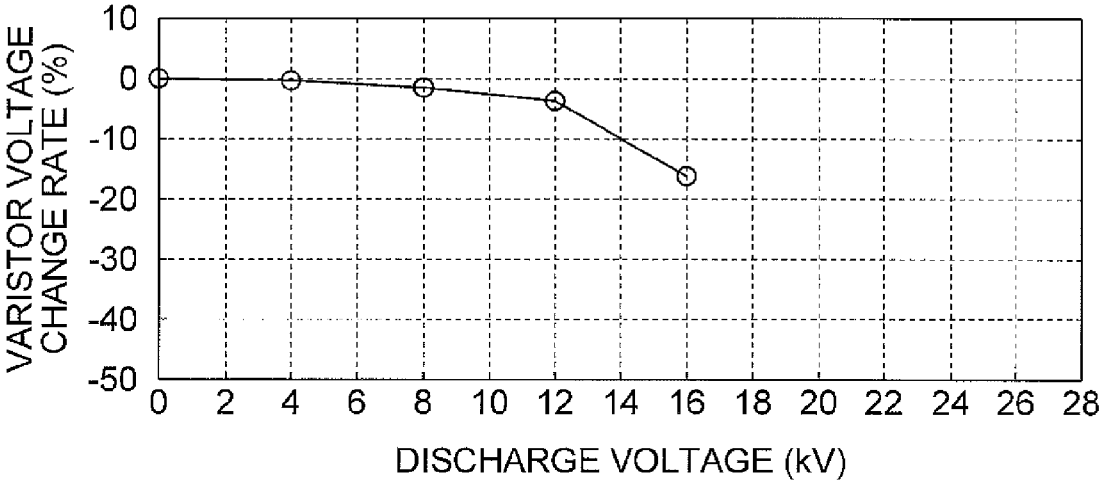

The measurement results are shown in FIGS. 6A and 6B. FIGS. 6A and 6B are graphs showing relations between discharge voltage (kV) and varistor voltage change rate (%). FIG. 6A shows the measurement result of the chip varistor 1 according to Example, and FIG. 6B shows the measurement result of the multilayer chip varistor 101 according to Comparative Example. The varistor voltage change rate is expressed by a percentage of a ratio of varistor voltage $V_{1\ mA}$ with application of a discharge voltage to an initial value, the initial value being defined as a varistor voltage $V_{1\ mA}$ without application of discharge voltage (i.e., with the discharge voltage of 0 kV).

It was confirmed by the results shown in FIGS. 6A and 6B that the present embodiment successfully prevented the drop of ESD tolerance. Namely, the chip varistor 1 of Example has the higher breakdown discharge voltage than the multilayer chip varistor 101 of Comparative Example. In the measurement herein, a sample was determined to undergo breakdown, at 10% or more change of the varistor voltage change rate.

Figure 7:
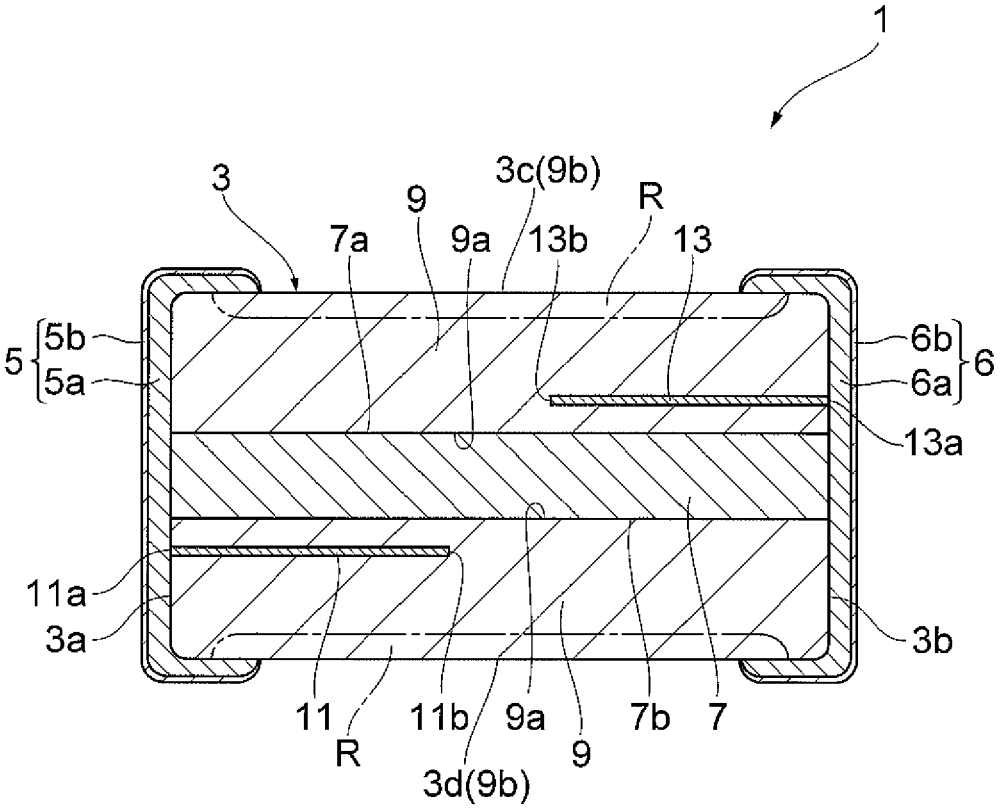
FIG. 7 is a drawing for explaining a cross-sectional configuration of a chip varistor according to a modification example of the embodiment.

The below will describe a configuration of a modification example of the chip varistor 1 according to the embodiment, with reference to FIG. 7. FIG. 7 is a drawing for explaining a cross-sectional configuration of the chip varistor according to the modification example of the embodiment. The present modification example is different in the range of the resistance-increased region R from the aforementioned embodiment.

The element body 3 has the resistance increased from the sides of the four side faces 3*c*-3*f* in the exterior surface and the element body 3 has the resistance-increased region R along each side face 3*c*-3*f*. Namely, each element body section 7, 9 has the region R on the sides of the corresponding side faces 3*c*-3*f*. The element body 3 does not have the resistance-increased region R on the sides of the respective end faces 3*a*, 3*b*.

In the present modification example, the resistance-increased region R can be formed as described below.

After the element body 3 is provided, the first and second terminal electrodes 5, 6 are formed on the element body 3. Thereafter, at least one element selected from the group consisting of alkali metals (e.g., Li, Na, and so on), Ag, and Cu is diffused from the exterior surface of the element body 3 (the four side faces 3*c*-3*f*) exposed from the first and second terminal electrodes 5, 6. The same technique as in the aforementioned embodiment can also be adopted as a method of diffusing at least one element selected from the group consisting of alkali metals (e.g., Li, Na, and so on), Ag, and Cu. The chip varistor 1 of the present modification example is obtained through these steps.

The present modification example can also ensure a desired clamp property and prevent the drop of ESD tolerance.

Figure 8:
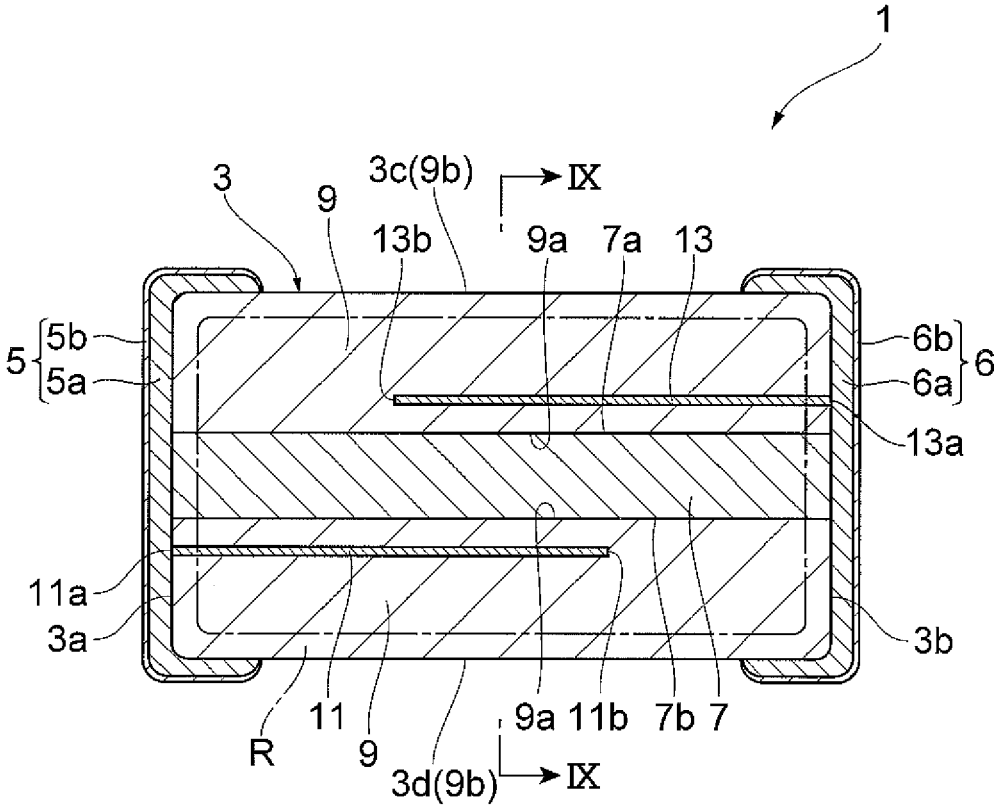
FIG. 8 is a drawing for explaining a cross-sectional configuration of a chip varistor according to a modification example of the embodiment.
Figure 9:
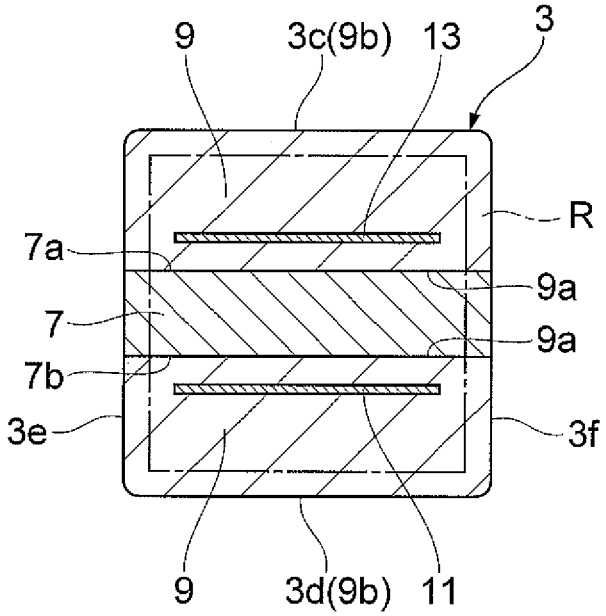
FIG. 9 is a drawing for explaining a cross-sectional configuration along the line IX-IX in FIG. 8.

Next, a configuration of another modification example of the chip varistor 1 according to the embodiment will be described with reference to FIGS. 8 and 9. FIG. 8 is a drawing for explaining a cross-sectional configuration of the chip varistor according to the modification example of the embodiment. FIG. 9 is a drawing for explaining a cross-sectional configuration along the line IX-IX in FIG. 8. The present modification example is different in the configuration of the first and second conductors 11, 13 from the aforementioned embodiment.

In the present modification example, the first conductor 11 and the second conductor 13 have a mutually overlapping portion when viewed from the direction in which the side face 3*c* and the side face 3*d* are opposed to each other. The shortest distance between the first conductor 11 and the second conductor 13 is defined by the distance between the first conductor 11 and the second conductor 13 in the direction in which the side face 3*c* and the side face 3*d* are opposed to each other.

The present modification example can also ensure a desired clamp property and prevent the drop of ESD tolerance. In the present modification example, the first conductor 11 and the second conductor 13 have the mutually overlapping portion, whereby the resistance is reduced and the excellent clamp property is achieved.

The preferred embodiments of the present invention were described above and it is noted that the present invention is not always limited to the above embodiments but can be modified in many ways without departing from the spirit and scope of the invention.

The first element body section 7 may contain Bi, instead of the rare earth metal. In this case, as described above, the second element body sections 9 preferably do not contain Bi. The first element body section 7 may contain the rare earth metal and Bi. In this case, the second element body sections 9 preferably do not contain the rare earth metal and Bi.

The second element body sections 9 may be comprised of a composite material of a metal (e.g., an Ag—Pd alloy, Ag, Au, Pd, or Pt) and a metal oxide (e.g., ZnO, CoO, NiO, or $TiO_2$). The metal oxide is preferably ZnO, which is the same as the metal oxide contained in the first element body section 7.

The element body 3 does not always have to be subjected to diffusion of at least one element selected from the group consisting of alkali metals (e.g., Li, Na, and so on), Ag, and Cu.

Figure 10:
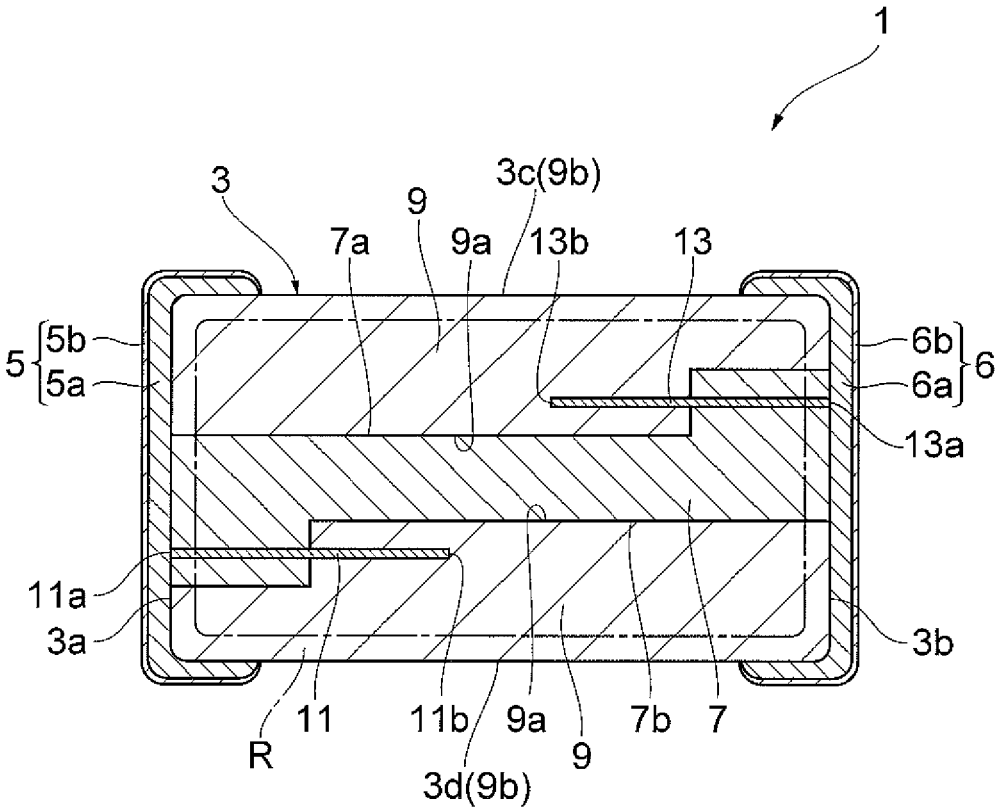
FIG. 10 is a drawing for explaining a cross-sectional configuration of a chip varistor according to a modification example of the embodiment.

The first conductor 11 and the second conductor 13 do not always have to be located as a whole in the second element body sections 9. For example, as shown in FIG. 10, the first conductor 11 and the second conductor 13 may be configured in such a structure that the other end 11*b* of the first conductor 11 and the other end 13*b* of the second conductor 13 are located in the second element body sections 9 and the remaining portions of the first and second conductors 11, 13 are located in the first element body section 7. FIG. 10 is a drawing for explaining a cross-sectional configuration of a chip varistor according to a modification example of the embodiment.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A chip varistor comprising:

an element body having a first face and a second face opposed to each other;

a first conductor arranged in the element body so as to have one end exposed in the first face and the other end located in the element body;

a second conductor arranged in the element body so as to have one end exposed in the second face and the other end located in the element body and so as to be separated from the first conductor;

a first terminal electrode arranged on the first face side of the element body and connected to the first conductor; and a second terminal electrode arranged on the second face side of the element body and connected to the second conductor, wherein the element body has a first element body section having the nonlinear voltage-current characteristics, and a second element body section in which an electric current is more likely to flow than in the first element body section, wherein the first element body section is located at least in part between the first conductor and the second conductor, in a direction in which the first conductor and the second conductor are separated from each other, and wherein the other end of the first conductor and the other end of the second conductor are located in the second element body section.

2. The chip varistor according to claim 1, wherein the first conductor and the second conductor are located as a whole in the second element body section.

3. The chip varistor according to claim 1, wherein the first conductor and the second conductor have a mutually overlapping portion when viewed from a direction perpendicular to a direction in which the first face and the second face are opposed to each other.

4. The chip varistor according to claim 1, wherein a portion of the element body exposed from the first terminal electrode and the second terminal electrode has a resistance increased from the surface side of the element body.

5. The chip varistor according to claim 1, wherein the element body has:

the first element body section; and a pair of said second element body sections arranged so as to interpose the first element body section between the second element body sections in a direction perpendicular to a direction in which the first face and the second face are opposed to each other, wherein the first conductor is arranged in one of the second element body sections so as to be opposed to the first element body section, and wherein the second conductor is arranged in the other of the second element body sections so as to be opposed to the first element body section.

* * * * *